US006434803B1

(12) United States Patent
Spong

(10) Patent No.: US 6,434,803 B1
(45) Date of Patent: Aug. 20, 2002

(54) GARMENT HANGER POSITIONING AND LOCKING DEVICE

(76) Inventor: Alfred Spong, 4635 Westlawn Parkway, Waterford, MI (US) 48328

( * ) Notice: Subject to any disclaimer, the term of this patent is extended or adjusted under 35 U.S.C. 154(b) by 0 days.

(21) Appl. No.: 09/680,860

(22) Filed: Feb. 9, 2001

(51) Int. Cl.[7] ..... A44B 1/00; A41H 43/00; A41F 1/00

(52) U.S. Cl. ..... 24/543; 24/30.5 P; 24/30.5 R

(58) Field of Search ..... 24/543, 30.5 S, 24/30.5 R, 30.5 P; 248/68.1, 74.2, 74.4; 223/85, 88, 89; 211/99, 113, 116

(56) References Cited

U.S. PATENT DOCUMENTS

| | | | | | |
|---|---|---|---|---|---|
| 3,906,592 | A | * | 9/1975 | Sakasegawa et al. | 248/68.1 |
| 4,872,568 | A | * | 10/1989 | Lehmann | 211/113 |
| 5,072,837 | A | * | 12/1991 | Rosch | 211/116 |
| 5,115,542 | A | * | 5/1992 | Gehres | 24/543 |
| 5,224,674 | A | * | 7/1993 | Simons | 248/68.1 |
| 5,389,082 | A | * | 2/1995 | Baugues et al. | 24/543 X |
| 5,535,969 | A | * | 7/1996 | Duffy, Jr. | 248/68.1 |
| 5,671,876 | A | * | 9/1997 | Gardner | 223/1 |
| 5,901,888 | A | * | 5/1999 | Schneider et al. | 223/89 |
| 6,142,429 | A | * | 11/2000 | Ahroni | 248/74.2 |

* cited by examiner

*Primary Examiner*—Robert J. Sandy

(57) ABSTRACT

A reusable, flexible positioning and locking clip for garment hangers and other cylindrical objects and the like that proportionally positions, and locks garment hangers or other cylindrical objects into place.

1 Claim, 3 Drawing Sheets

GARMENT HANGER POSITIONING AND LOCKING DEVICE

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

Art hereto for garment hangers have been bundled together utilizing paper wrapped wire ties. While the paper wrapped wire do not proportionally space the garment hangers, or lock them into a definite position. The paper wrapped wire ties simply bind the garment hangers together without order. A major difficulty with the prior art is that the paper wrapped wire ties permit the garment hangers to become tangled together making storage, transportation and use difficult. Heretofore no other prior art is addresses and solves this problem.

1. Field of Invention

In many applications there is a need to clip objects for the purposes of identification, bundling, and closing. Reusable clips are well known in commerce; as described in U.S. Pat. No. 6,058,572 and U.S. Pat. No. 5,598,608 are reusable clips for plastic bags, of some similar inventorship herewith, they may comprise of a pair of generally co-extensive, axially extending jaws. These inventions comprise a method to seal plastic bags when the jaws are closed applying pressure to the resilient plastic bags therefore sealing them.

2. Description or Related Art

Not Applicable.

BRIEF SUMMARY OF INVENTION

A reusable, flexible positioning and locking clip for garment hangers and other cylindrical objects and the like that proportionally positions, and locks objects into place, comprising of two mutually confronting jaws hinged together with locking device whereby said jaws are rotatable into a closed, mutually confronting relationship with said channels opposing one and other forming an encasement for said garment hanger or other cylindrical objects or the like, thus proportionally spacing and locking objects into place.

BRIEF DESCRIPTION OF THE DRAWINGS

FIG. 2 is a detailed perspective view of Clip 10 indicating components of my invention

Reference Numerals

Figure 1:
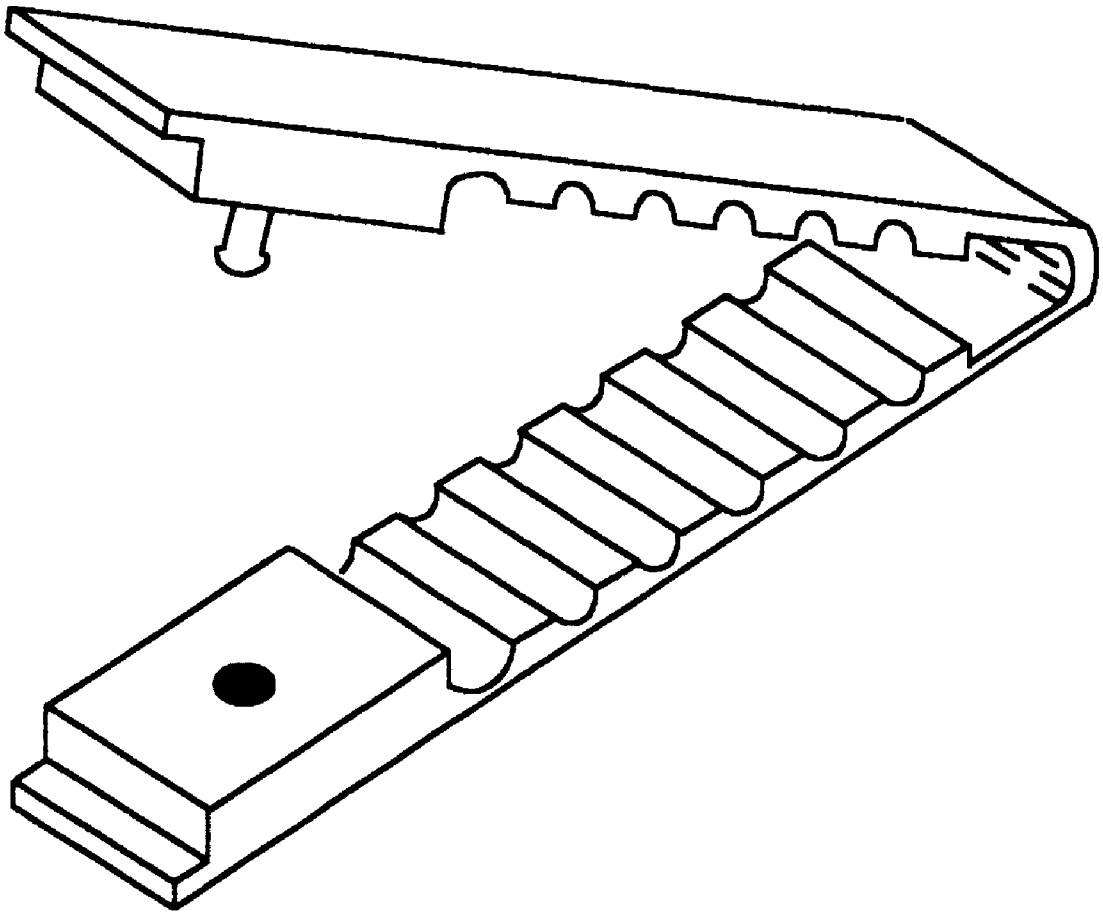
FIG. 1 is a perspective view of the garment hanger clip IO invention.
Figure 5:
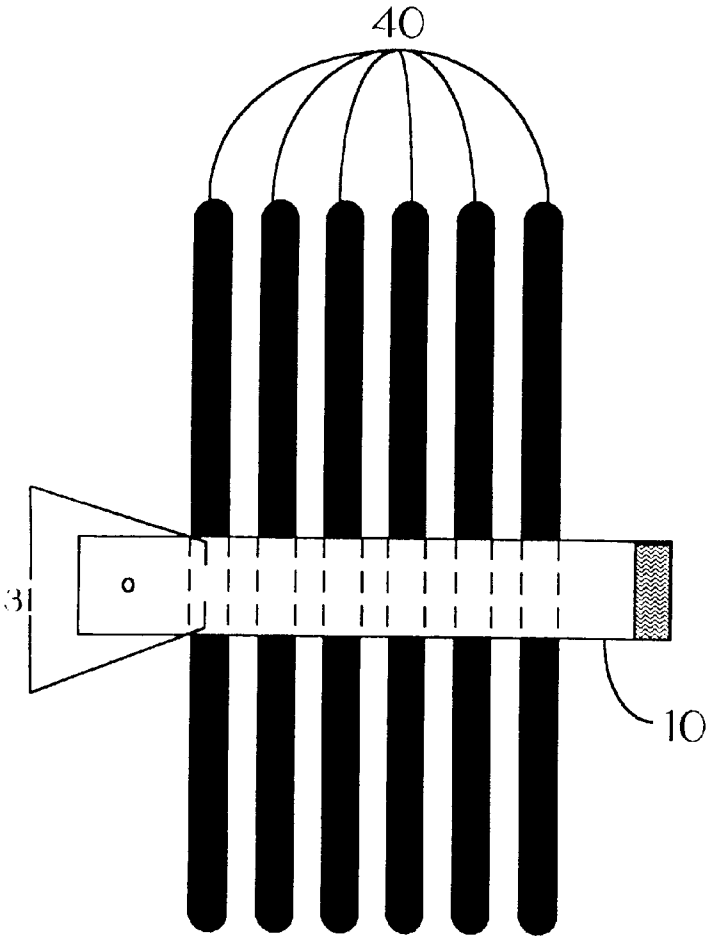
FIG. 5 is a side view of Clip showing multiple hangers 40 locked into place and section lines 41 for FIG. 6.

10 FIG. 1 Garment Hanger Clip
40 FIG. 5 Garment Hangers
41 Garment Hanger neck

DETAILED DESCRIPTION OF THE INVENTION

This invention incorporates a pair of generally coextensive, axially extending jaws, the jaws are hinged in the center so to be collapsible into mutually confronting relationship, with the channel opening on one jaw aligning with the channel opening on the opposing jaw, so as to create an opening to receive the garment hanger. The channels are spaced to allow for the garment to be hung on the garment hanger and positioned, clipped and locked together. Locking means are disposed at the end of the axial ends of the jaws opposed to the hinge for locking the jaws in the closed position. A garment hanger is held and locked into the channels that form an encasement by the compression of the opposing jaws. The opposing jaws are locked together by the means of a cylindrical protrusion with a slightly larger bulb at the end of one opposing jaw fitting into a slightly smaller hole in the receiving opposing jaw. Being that clips may be used with many different sized garment hangers, thereby causing some garment hangers to be more tightly bound than others.

These clips may be made of many different types of plastic. The use of recycled plastic may provide an important economy in the manufacturing costs, and potentially facilitate the packaging of bulk garment hangers with clips for distribution.

It is the object of this invention to provide clips, which facilitate the positioning of garment hangers or other cylindrical objects relative to the clip prior to closure.

It is another object of this invention to provide clips that facilitate orderly positioning and locking in place multiple garment hangers or other cylindrical objects after closure.

It is another object of this invention to provide clips, which facilitate ease and timesavings of related to the utilization.

It is another object of this invention to provide clips, which facilitate the grouping of multiple garment hangers for delivery to a single customer. It is another object of this invention to provide CLIPS, WHICH facility grouping of like, or necessary cylindrical objects together.

FIG. 1. Garment Hanger Clip in accordance with the invention is identified generally by the numeral 10.

Figure 3:
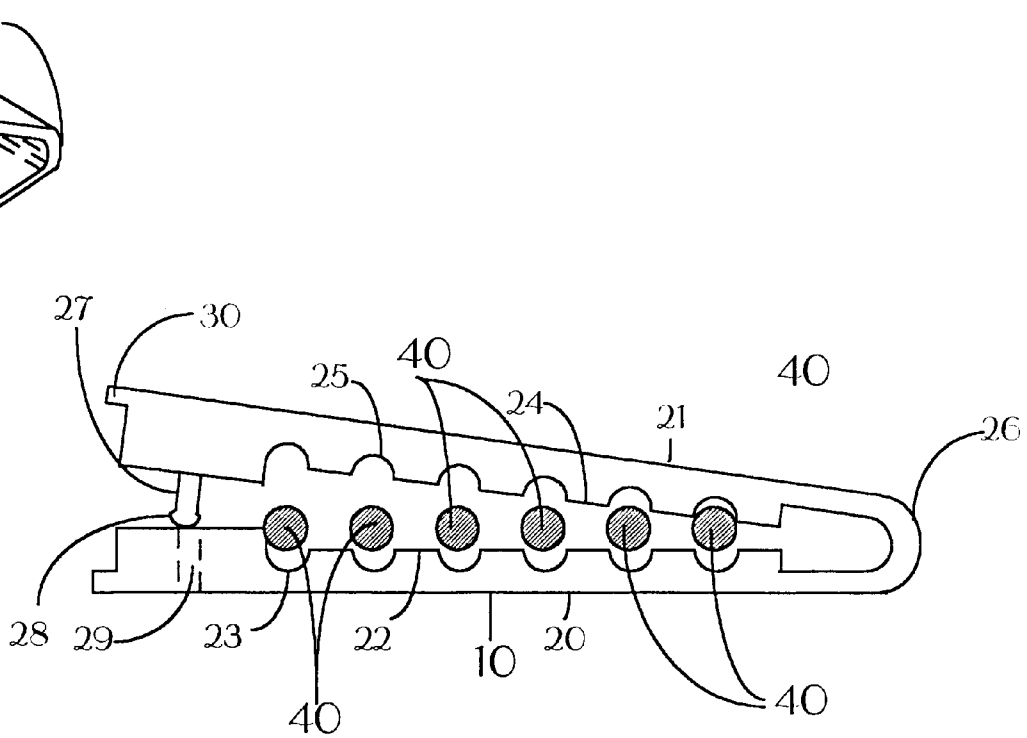
FIG. 3 is a detailed view of Clip 10 showing the opposing jaws partially closed, showing cut-a-way garment hangers prior to being locked into place.
Figure 2:
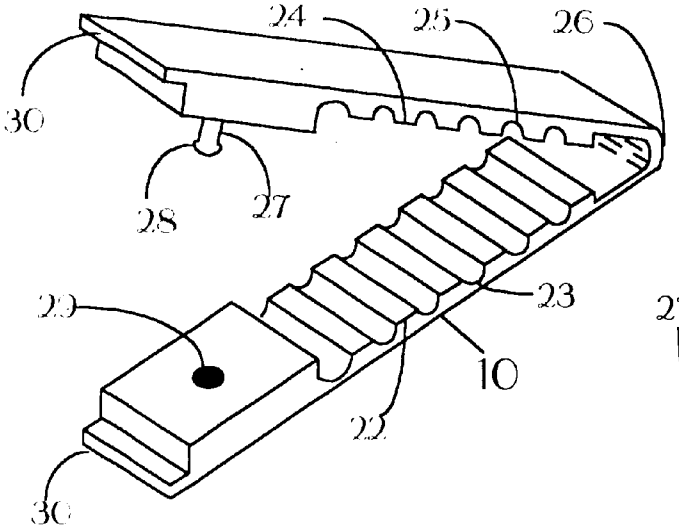
FIG. 2 shows
Figure 4:
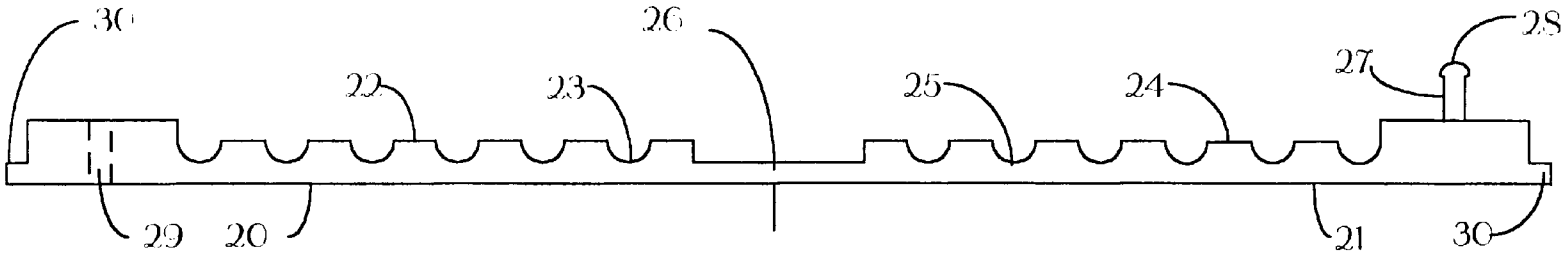
FIG. 4 is a detailed top view of the opened Clip IO.

FIG. 2. & FIG. 3. Garment Hanger Clip IO comprises of first jaw 20 including platform 22 upstanding there from and channel 23 imbedded therein-aligned perpendicular to the axis. Clip 10 further comprises a second jaw 21 including platform 24 upstanding there from and channel 25 imbedded therein aligned perpendicular to the axis and directly opposed from platform 22 and channel 23. Jaws 20 and 21 are connected by hinge 26 to permit jaws to be swung into mutually confronting position. Jaw 20 and 21 include a co-operative locking means. Jaw 20 comprises a cylindrical opening 29, and Jaw 21 comprising of cylindrical protrusion 27 with locking bulb 28 in an axially opposed relationship to hinge 26. Clip 10 protrusion 27 with locking bulb 28 inserts into cylindrical opening 29 locking Jaws 20 and 21 in a mutually confronting position. Jaws 20 and 21 comprise protrusions 23 horizontally there from serving as means of unlocking Jaws 20 and 21.

FIG. 5. Clip 10 side view showing multiple Garment Hangers 40 positioned in channels 23 and 25 in platforms 22 and 24. Clip 10 showing cut-a-way FIG. 6 Garment Hanger 40 positioned in channels 23 and 25 in platforms 22 and 24.

Figure 6:
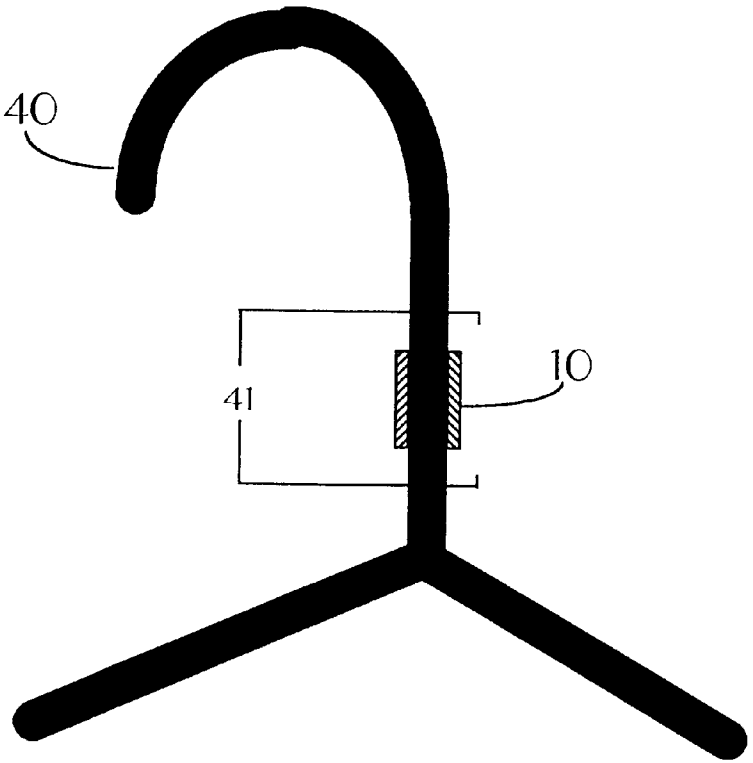
FIG. 6 is an end cut-a-way view of Clip IO showing the garment hanger 40 and neck 41, positioned and locked into place in the Clip IO.

FIG. 6. Clip IO cut-a-way showing FIG. 6 Garment Hanger neck 41 positioned in channels 23 and 25 locked into place.

OBJECTS AND ADVANTAGES

Accordingly, several objects and advantages of my invention are a clip with multiple channels proportioned along the opposing jaws so that when closed and locked the channels are equally opposed. Suitably the jaws in the confronting position will be spaced proportionally so as to provide an enclosure there between within which the neck of the garment hanger or other cylindrical objects will locate and be locked into position.

A clip of this nature will permit the neck of the garment hangers or other cylindrical objects to be proportionally spaced and locked together. Accordingly, it is less likely that the garment hangers or other cylindrical objects will become separated or tangled together during storage, delivery to customer and transportation to said customer destination.

Still further objects and advantages will become apparent from a consideration of the ensuing description and accompanying drawings.

Preferred Embodiment Operation

Clip IO is used to position and lock garment hangers 40 or other cylindrical objects together for ease of identification, handling and transportation multiple hangers and objects. Clip 10 is placed around Garment Hangers 40 and Jaws 20 and 21 are closed to a mutually confronting position while cylindrical protrusion 26 is inserted into cylindrical opening 29 until the securing bulb 28 passes through the opening in Jaw 20. The degree of which Clip IO may grip garment hangers 40 may be controlled by the diameter of the closed channels 23 and 25. Other variations will occur to those skilled in the art.

Conclusions, Ramifications, and Scope

Accordingly, it can be seen that the invention provides a device that groups together multiple garment hangers together and locks them into place. The invention is resilient, reusable, reliable, easy to fabricate and use. The invention can be made of recycled plastic. As stated the invention can be used to clip and lock into place garment hangers or any other cylindrical objects and the like.

Although the description above contains much specificity, these should not be construed as limiting the scope of the invention but as merely providing illustrations of some of the presently preferred embodiments of this invention. Various other embodiments and ramifications are possible within its scope. For example, the clip may be used to clip wires, metal or plastic pipe and tubes, metal or plastic rods, fishing poles, golf clubs. Thus the scope of the invention should be determined by the appended claims and their legal equivalents, rather than by the examples given.

What is claimed is:

1. A method of binding multiple garment hangers together, comprising the steps of:

providing a garment hanger positioning and locking device, the device having a pair of generally co-extensive, axially extending jaws, the jaws being hinged to one another at a respective end thereof so as to be collapsible into mutually confronting and opposing relationship to one another with channel openings of one of the jaws aligning with channel openings of the other jaw to receive a garment hanger, the jaws being collapsible together to a closed position by a locking means, the locking means being a cylindrical protrusion with a slightly larger bulb at the distal end of one of the jaws, and a slightly smaller hole at a distal end position of the jaw for receiving the bulb to lock the bulb to lock the jaws in the closed position:

positioning the garment hanger positioning and locking device around individual hangers so that each channel of one of the jaws receives a hanger neck of the hanger;

collapsing the jaws in a mutually confronting and opposing relationship to form an encasement around each individual garment hanger by compression of the opposing jaws toward one another; and locking the distal end portions of the opposing jaws into one another by fitting the bulb into the hole.

* * * * *